US007270470B1

(12) United States Patent
Johnson

(10) Patent No.: US 7,270,470 B1
(45) Date of Patent: Sep. 18, 2007

(54) FEED EXTENDER FOR EXPLOSIVE MANUFACTURE

(75) Inventor: Sharperson G. Johnson, Upper Marlboro, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 223 days.

(21) Appl. No.: 10/826,792

(22) Filed: Apr. 9, 2004

(51) Int. Cl.
*B01F 15/02* (2006.01)

(52) U.S. Cl. ..... 366/76.9; 366/183.1; 366/341

(58) Field of Classification Search .... 366/76.9–76.92, 366/9, 154.1, 183.1, 341; 222/459, 547, 222/564

See application file for complete search history.

(56) References Cited

U.S. PATENT DOCUMENTS

| | | | | |
|---|---|---|---|---|
| 670,222 | A * | 3/1901 | Campbell | 366/9 |
| 846,751 | A * | 3/1907 | Melvin | 366/9 |
| 1,218,250 | A * | 3/1917 | Fox | 366/183.1 |
| 1,268,813 | A * | 6/1918 | Benjamins | 366/76.9 |
| 1,689,143 | A | 10/1928 | Lukachovic et al. | |
| 1,845,847 | A * | 2/1932 | Reuther | 222/459 |
| 2,245,488 | A * | 6/1941 | Marcuse | 222/233 |
| 3,378,235 | A * | 4/1968 | Udy et al. | 366/154.2 |
| 3,592,444 | A * | 7/1971 | Arvanitakis | 366/153.1 |
| 4,191,480 | A * | 3/1980 | Hiorth | 366/336 |
| 4,369,689 | A * | 1/1983 | Donaghue et al. | 86/20.15 |
| 4,461,660 | A | 7/1984 | Binet et al. | |
| 4,606,647 | A * | 8/1986 | Frye | 366/168.1 |
| 4,614,146 | A * | 9/1986 | Ross et al. | 366/40 |
| 4,688,945 | A * | 8/1987 | Brazelton et al. | 366/156.1 |
| 4,832,497 | A * | 5/1989 | Wentzel | 366/9 |
| 4,986,456 | A * | 1/1991 | Johanson | 222/561 |
| 5,096,302 | A * | 3/1992 | Durina | 366/76.92 |
| 5,405,049 | A * | 4/1995 | Ricciardi | 222/1 |
| 5,596,232 | A | 1/1997 | Lefumeux | |
| 5,769,009 | A | 6/1998 | Saitoh | |
| 5,772,319 | A * | 6/1998 | Pemberton et al. | 366/76.2 |
| 5,826,519 | A | 10/1998 | Saitoh | |
| 6,199,509 | B1 | 3/2001 | Mostyn et al. | |
| 6,267,495 | B1 * | 7/2001 | Hurst | 366/76.91 |
| 6,472,615 | B1 * | 10/2002 | Carlson | 177/16 |
| 6,582,160 | B2 * | 6/2003 | Campbell et al. | 406/131 |

FOREIGN PATENT DOCUMENTS

| | | | |
|---|---|---|---|
| GB | 2136407 | A * | 9/1984 |

* cited by examiner

*Primary Examiner*—Charles E. Cooley
(74) *Attorney, Agent, or Firm*—Fredric J. Zimmerman

(57) ABSTRACT

A feed device extends the run time for manufacturing explosive materials. The feed device includes a feed hopper for retaining processing materials where the feed hopper includes an access at the top of the feed hopper for inputting processing materials and an extender attached to the top of the feed hopper. The extender includes at least one baffle fixed within the interior of the extender. Processing material is conveyed from the extender through the access and into the feed hopper.

4 Claims, 1 Drawing Sheet

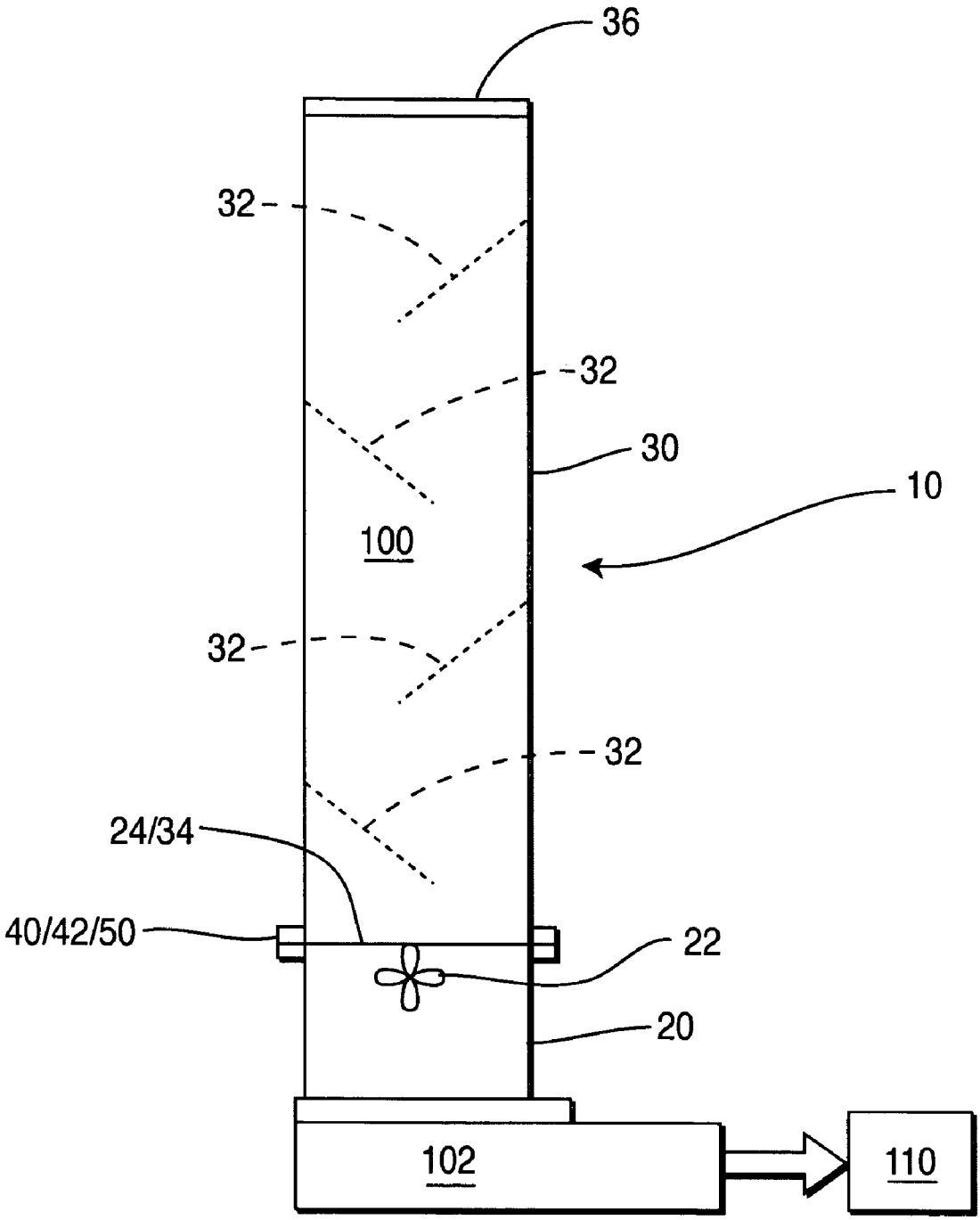
36
32
32
30
10
100
32
32
24/34
40/42/50
22
20
102
110

FEED EXTENDER FOR EXPLOSIVE MANUFACTURE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention provides a device and method for extending the run time of manufacturing explosives.

2. Brief Description of the Related Art

Manufacture of explosive materials is complicated by the special handling considerations required, such as when processing solid processing materials. When densely packed, the processing materials used to produce the explosive materials tend to conglomerate together which impedes the efficient production of the manufactured explosive materials. As such, the use of unit batch runs for solid explosive manufacture is common. Additionally, special handling precautions of certain components in the manufacturing process are required to prevent the possibility of an accidental explosive event.

Unit batch processing, however, limits the time and amount of explosive materials that may be manufactured at a given time. Accordingly, there is a need in the art to provide for extended run time in the manufacture of solid explosive materials. The present invention addresses this and other needs.

SUMMARY OF THE INVENTION

The present invention includes a feed device for extending the processing runs of manufacturing explosive materials comprising a feed hopper for retaining processing materials, the feed hopper having an access at the top of the feed hopper for inputting processing materials therein and an extender attached to the top of the feed hopper, the extender having one or more baffles fixed within the interior of the extender, wherein the extender is attached to the top of the feed hopper effective for conveying processing materials, from the extender, through the access and into the feed hopper.

The present invention also includes a method for augmenting a feed hopper for manufacturing explosive materials comprising the steps of providing the above-described feed device and conveying processing materials from the extender into the feed hopper. The present method provides an extended explosive manufacture process and a continuous explosive manufacture process.

BRIEF DESCRIPTION OF THE DRAWINGS

FIG. 1 illustrates the feed device for manufacturing explosive materials of the present invention having an extender placed on top of a feed hopper for processing materials.

DETAILED DESCRIPTION OF THE PREFERRED EMBODIMENT

The present invention provides a device, and method, for extending the processing run of solid processing materials for manufacturing explosive materials. Processing materials include, for example, plasticizers, explosive components, binders, thermoplastic compositions, and other like powdery substances useful in the manufacture of explosive compositions.

As seen in FIG. 1, the present invention includes a feed device 10 for extending the processing runs of manufacturing explosive materials 110. The feed device 10 includes a feed hopper 20 which has an attached extender 30 on the top of the feed hopper 20. The feed hopper 20 retains a specified amount of processing materials 100 that are fed into a processing apparatus 102 for manufacturing explosives 110. Within the feed hopper 20, an agitator 22 is used to mix and disperse the processing materials 100 in a manner to facilitate the transfer of the processing materials 100 into the processing apparatus 102. Processing materials 100 in the feed hopper 20 are agitated to retain the powdery composition of the processing materials 100, as the processing materials 100 are gravity fed out of the feed hopper 20. The agitation provides the amount of mixing necessary for the processing materials 100 to appropriately exit the feed hopper 20.

Problematic with the feed hopper 20 is the limited amount of processing materials 100 that can be held therein. Generally, the processing materials 100, including explosive and non-explosive components, are composed of powdery compositions that are easily compacted. When stored in large amounts, such as over about 8 inches, the weight of the processing materials 100 causes a gelling or conglomeration of the processing materials 100. Baffling systems within the feed hopper 20 are generally precluded as they would interfere with the proper functioning of the agitator 22.

Referring again to FIG. 1, in combination with the feed hopper 20, the present invention further provides an extender 30 to augment the amount, and accordingly the run time, of the processing materials 100 that may be feed through a given feed hopper 20 for a given explosive manufacturing run. With the use of the extender 30 of the present invention an increase of the amount of processing materials 100 available for manufacturing the explosive materials 110 is provided over the amount available from the feed hopper 20. The extender 30 uses a system of baffles 32 to support the internally held processing materials 100. By using a baffling system of one or more baffles 32 within the extender 30, the present invention allows incorporation of increasing amounts of processing materials 100 in the manufacturing process. The extender 30 fits on top of, and has access into, the feed hopper 20 for inputting processing materials 100 therein. An opening 34 at the bottom of the extender fits over an access 24 at the top of the feed hopper 20. The access 24 into the top of the feed hopper 20 provides a conduit between the extender 30 and the feed hopper 20 that allows the gravity feed of the processing materials 100 from the extender 30 into the feed hopper 20 as the amount of processing materials 100 from the feed hopper 20 are released into the processing apparatus 102. In a preferred embodiment, the opening 34 and access 24 have a diameter substantially equal to the internal diameter of both the feed hopper 20 and extender 30. The extender 30 may be permanently or temporary attached to the top of the feed hopper 20, as described herein. With the extender 30 attached to the top of the feed hopper 20, a gravity feed provides an effective means for conveying processing materials 100, from the extender 30, through the access and into the feed hopper 20.

Preferably, the extender 30 comprises a substantially uniform interior diameter. More preferably, the interior diameter of the extender 30 is substantially the same as that of the feed hopper 20. The extender 30 may include complimentary functional parts, such as having external handles for ease of handling, rounded edges, covers for protecting the held processing materials 100 when the extender 30 is not attached to the feed hopper 20, and other such features compatible with protecting the contained processing materials 100, transporting the extender 30, and other such safety or efficiency implements for the manufacture of explosives as may be determinable by one skilled in the art.

The vertical dimensions of the extender 30 generally replicate those of the feed hopper 20, such as a circular, oval, square, rectangular, etc. shape. Most common are rectangular configurations, both internally and externally. Preferably, in whichever configuration, the internal diameter of the extender 30 remains constant along the entire vertical length of the extender 30. Access 36 into the top of the extender 30 is present, as desired, such as with the use of an opening with a covering mechanism for allowing access to the processing materials 100 while providing protection of the processing materials 100 when access is not needed.

The extender 30 has one or more baffles 32, or rows of baffles 32, fixed within the interior of the extender 30. These baffles 32 extend from the inner sides of the extender 30 into the center of the extender 30 and cover a substantially amount of the internal diameter of the extender 30. The baffles 32 preferably traverse at least 50% of the internal diameter of the extender 30, with a traversal amount of from about 70% to about 80% more preferred. Baffles 32 may be arranged along a plurality of baffle levels within the extender 30, preferably inter-spaced at equal vertical distances with the extender 30, allowing each level to retain a given amount of the processing materials 100. As each level of baffles 32 retains a given amount of processing materials 100, the weight of the processing materials 100 remains segmented within the extender 30. Preferably, there are two or more baffles 32 positioned at an equal number of levels, i.e., each baffle 32 is at a different level, with from about 2 to about 7 baffles 32 more preferred. The baffles 32 within the extender 30 are suitably canted or slanted to effectively permit the transfer of processing material 100 from the interior of the extender 30 into the feed hopper 20 as the lower amounts of processing materials 100 are used. Preferred effective angles include, for example, angles of from about 30 degrees to about 60 degrees, more preferably from about 40 degrees to about 50 degrees, and most preferably an angle of about 45 degrees. Generally, the baffles 32 may substantially cover a cross-sectional area of the extender 30. Baffle system have been disclosed in such patents as U.S. Pat. No. 6,199,509 to Mostyn et al., which discloses several baffle configurations in FIGS. 2-6, as described at column 2, line 62 to column 3, line 35 in the Mostyn et al. Patent. The disclosure of the Mostyn et al. Patent with regard to the disclosure of baffles is herein incorporated by reference.

The feed device 10 of the present invention may further include an attaching mechanism 40 that attaches the extender 30 to the feed hopper 20. The attaching mechanism 40 forms a seal 42 between the extender 30 and feed hopper 20 that defines a sufficiently configured conduit for the effective transfer of processing materials 100 from the extender 30 into the feed hopper 20. The attaching mechanism 40 may include a collar section at the bottom of the extender 30 and/or top of the feed hopper 22 for promoting the fitting, sealing, or other mating between the extender 30 and feed hopper 20. Representative types of attaching mechanisms 40 include such devices as a clamps, screw fastener, latching device, collar support and the like. In one embodiment, the attaching mechanism 40 may include a locking mechanism to lock the extender 30 onto the feed hopper 20. The attaching mechanism 40 may further include a gravity seal connection, such as an indentation along the top of the feed hopper 20 configured to receive the bottom portion of the extender 30, to be inserted therein, to limit the lateral movement of the extender 30 from vibration, inadvertent contact, equipment shifting or other like incidental or accidental movement. This gravity seal connection allows easy placement of the extender 30 onto the top of the feed hopper 20, but generally is insufficient by itself to provide a reliable closure between the feed hopper 20 and extender 30 for reliable transfer of the processing materials 100. Additionally, a gasket 50 is used along the seal between the feed hopper 20 and extender 30 to ensure an air-tight fit. Preferably, the attaching mechanism 40 comprises a clamp.

In operation, the above-described feed device 10 of the present invention is used to augment the quantity of processing material 100 of the feed hopper 20 for a given run in the manufacture of explosive materials 110. Once attached to the feed hopper 20, the extender 30 is filled with the appropriate processing materials 100 through the extender access 36 to a desired level. As the processing materials 100 within the feed hopper 20 are agitated, the processing materials 100 are fed out of the feed hopper 20 to the processing apparatus 102. With the removal of the processing materials 100 from the feed hopper 20, additional processing materials 100 are transferred from the extender 30 into the feed hopper 20. This augmentation of processing materials 100 extends the processing run times for manufacturing explosive materials 100 by increasing the amount of available processing materials 100 while not increasing the amount of weight of the processing materials 100 at the agitator 22, or elsewhere within the feed device 10 over the amount of each level of baffles 32. The processing materials 100 gravitates from the extender 30 into the feed hopper 20 through the access 24 at the top of the feed hopper 20. The baffles 32 within the extender 30 support the processing materials 100 which eliminates the bonding between the individual particles of the processing materials 100, which would occur from the weight of the particles themselves absent the presence of the baffles 32. As such, the transfer of the processing materials 100 from the feed hopper 30 to the processing apparatus 102, also conveys the processing materials 100 from the extender 30, through the access 24 at the top of the feed hopper 20, into the feed hopper 20. With additional levels of baffles 32 within the extender 30, additional amounts of processing materials 100 may be held within the extender 30 and conveyed into the feed hopper 20. Although the processing materials 100 are preferably conveyed into the feed hopper 20 through a gravity feed, vibration mechanisms and other like particle shifting devices may be used to augment the gravity feed process.

The baffles 32 may support appropriate amounts of processing materials 100 up to an amount that does not permit detrimental conglomeration of the particles that effectively interferes with the explosive making process. Preferably, each level of baffles 32 retains about the same amount of processing material 100 as that retained by the feed hopper 20. Representative amounts of processing materials 100 include from about 7 pounds of processing material or less. A second extender 32 may be used to augment a first extender 30 already in use on the top of the feed hopper 20, located either in a sequential or co-laterally configuration on top of the feed hopper 20. Other amounts of processing materials 100 may be retained by the baffles 32, such as having different amounts of processing materials 100 within the extender 30 and feed hopper 20, having different amounts of processing materials 100 at each baffle 32 level within the extender 30, having different internal diameters of the extender 30 at different baffle 32 levels, having various sizes and angles of different baffles 32 within the same extender 30, and other like modifications of the interior of the extender 30, and the number, shape, size and angle of the baffles 32, as may be best suited for a given explosive manufacturing process, particularly with regard to the type of processing materials 100, with such modifications determinable by those skilled in the art through ordinary experimentation in light of the disclosure herein.

The feed device 10, and method of augmenting a feed hopper using the feed device 10, of the present invention provides for both extended and continuous explosive manufacturing processes. Extended explosive manufacturing processes include runs beyond the amount of processing materials 100 available from the feed hopper 20 alone. As such, as a manufacturing cycle is being completed, and the amount of processing materials 100 available in the feed hopper 20 is insufficient to complete the cycle, additional amounts of processing materials 100 are made available using the processing materials 100 present in the extender 30. Continuous explosive manufacturing processes include on-going explosive manufacturing processes where new or additional processing materials 100 are repeatedly added, in one or more extenders 30, for conveyance into the feed hopper 20 and transferred out therefrom. As such, continuous explosive manufacturing processes theoretically include unlimited, e.g., not time dependent, manufacturing cycles.

EXAMPLE 1

A feed hopper for explosive having the capacity to process three-fourths of a desired explosive materials manufacturing run is augmented with an extender, having a single level of baffles, that is then filled with additional explosive materials. The combined amount of explosive available, in both the feed hopper and extender, provides enough processing materials to complete the full run without the need to conduct a second run.

EXAMPLE 2

A feed hopper for plasticizer having the capacity to process one-fourth of a desired explosive materials manufacturing run is augmented with the addition of an extender, having three levels of baffles. The extender is placed on top of the feed hopper, and latched thereto, after which it is filled with plasticizer materials. The combined amount of plasticizer available provides enough processing materials to complete the full run without the need to conduct a second run.

EXAMPLE 3

A feed hopper for plasticizer having the capacity to process one-fourth of a desired explosive materials manufacturing run is augmented with two extenders, each having two levels of baffles. The two extenders are fastened with screws onto the top of the feed hopper adjacent to each other. The two extenders are then filled with additional plasticizer materials. The combined amount of plasticizer available provides enough processing materials to complete the full run without the need to conduct a second run.

EXAMPLE 4

A feed hopper for plasticizer is used to manufacture explosive materials. An extender is placed on top of the feed hopper, and filled with five time the amount of plasticizer than that of the feed hopper. As the plasticizer is depleted from the extender, additional plasticizer is added to the extender through a top access port to maintain a continuous run.

The foregoing summary, description, and examples of the present invention are not intended to be limiting, but are only exemplary of the inventive features which are defined in the claims.

What is claimed is:

1. A method for augmenting a feed hopper for manufacturing explosive materials, comprising:

providing a feed device for extending processing runs of manufacturing explosive materials comprising a feed hopper for retaining processing materials, the feed hopper comprising an access at a top of the feed hopper for inputting processing materials therein and an extender being attached to the top of the feed hopper, the extender comprising at least two baffles being fixed within an interior portion of the extender, wherein the extender is attached to the top of the feed hopper effective for conveying processing materials, from the extender, through the access and into the feed hopper; and, conveying the processing materials used for producing the explosive materials from the extender into the feed hopper, wherein said at least two baffles are arranged along separate baffle levels where each baffle of said at least two baffles is inter-spaced at equal vertical distances so that said each baffle extends from an inner side of said extender and is oriented at an angle toward a lower baffle of said at least two baffles.

2. The method of claim 1, wherein the step of conveying the processing materials comprises an agitator.

3. The method of claim 1, wherein the baffles retain from about 7 pounds of the processing materials or less.

4. The method of claim 3, wherein each level of baffles retains about a same amount of the processing materials as retained by the feed hopper.

* * * * *